US005187955A

United States Patent [19]

Hertig et al.

[11] Patent Number: 5,187,955

[45] Date of Patent: Feb. 23, 1993

[54] CENTER SHAFT DYE INJECTION APPARATUS

[75] Inventors: Daniel M. Hertig; Grzegorz Osinski, both of Syracuse, N.Y.

[73] Assignee: G. A. Braun, Inc., Syracuse, N.Y.

[21] Appl. No.: 763,279

[22] Filed: Sep. 20, 1991

[51] Int. Cl.[5] ..... D06B 5/24

[52] U.S. Cl. ..... 68/58; 68/143; 68/148

[58] Field of Search ..... 68/58, 59, 27, 143, 68/148, 152, 153, 205 R

[56] References Cited

U.S. PATENT DOCUMENTS

| | | | |
|---|---|---|---|
| 1,300,233 | 4/1919 | Allsop et al. | 68/58 |
| 2,895,321 | 7/1959 | Mayberry et al. | 68/148 |
| 2,938,367 | 5/1960 | Sulzmann | 68/143 X |
| 4,726,318 | 2/1988 | Yamakita | 68/58 X |

FOREIGN PATENT DOCUMENTS

| | | | |
|---|---|---|---|
| 174882 | 5/1953 | Fed. Rep. of Germany | 68/58 |
| 1200558 | 6/1959 | France | 68/58 |
| 0215859 | 10/1985 | Japan | 68/148 |
| 2006966 | 1/1987 | Japan | 68/148 |

*Primary Examiner*—Philip R. Coe
*Attorney, Agent, or Firm*—Wall and Roehrig

[57] ABSTRACT

An improved apparatus and method for dyeing materials in a wet process dye extractor is shown in which the dyeing material is injected into a vessel containing a rotating perforated basket both through the center shaft of the rotating basket and also at a rear entry port in the vessel. The dual injection of dye material speeds up and improves the process of dyeing and allows dyeing from the "inside-out" as well as the "outside-in".

4 Claims, 2 Drawing Sheets

CENTER SHAFT DYE INJECTION APPARATUS

BACKGROUND OF THE INVENTION

This invention relates to wet processing of goods and more particularly, to a method and apparatus for dyeing a wide variety of goods. Prior art dyeing apparatus and processes have generally included a perforated basket of some sort which is rotated within a bath of liquid containing the dye material to be imparted to goods placed in the basket. After the goods have been properly colored by the dye material, the dye is generally removed by centrifugal force as the perforated basket is rotated at high speed and the liquid is drawn off to a sump for reuse or disposal as the case may be. Traditionally, the dye materials have been introduced to the liquid in the liquid chamber through a port in the wall in the chamber or alternatively by pumping the liquid into a pipe positioned at the axis of the rotating basket. The pipe usually carries a series of orifices or spray nozzles for introducing the liquid into the various compartments of the rotated basket so as to spray liquid die material through the goods as they are tumbled in the rotating basket.

OBJECTS OF THE INVENTION

Accordingly, it is an object of the present invention to provide an improved apparatus and method of injecting dye materials into a wet process machine for dyeing goods.

It is another object of the present invention to provide an apparatus and method for reducing the time required to wet process a given quantity of goods.

It is another object of the present invention to provide an apparatus and method for improving the distribution of dye material within a wet processing apparatus.

In one embodiment of the present invention, this is accomplished by introducing dye material into the vessel containing the liquid for the wet processing operation through a first inlet in the housing, generally below the level of the liquid and by also introducing the dye material into a hollow pipe positioned along the axis of the rotatable basket, having orifices for spraying the dye material into the compartments of the basket as it is rotated about its axis.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF A PREFERRED EMBODIMENT

Figure 1:
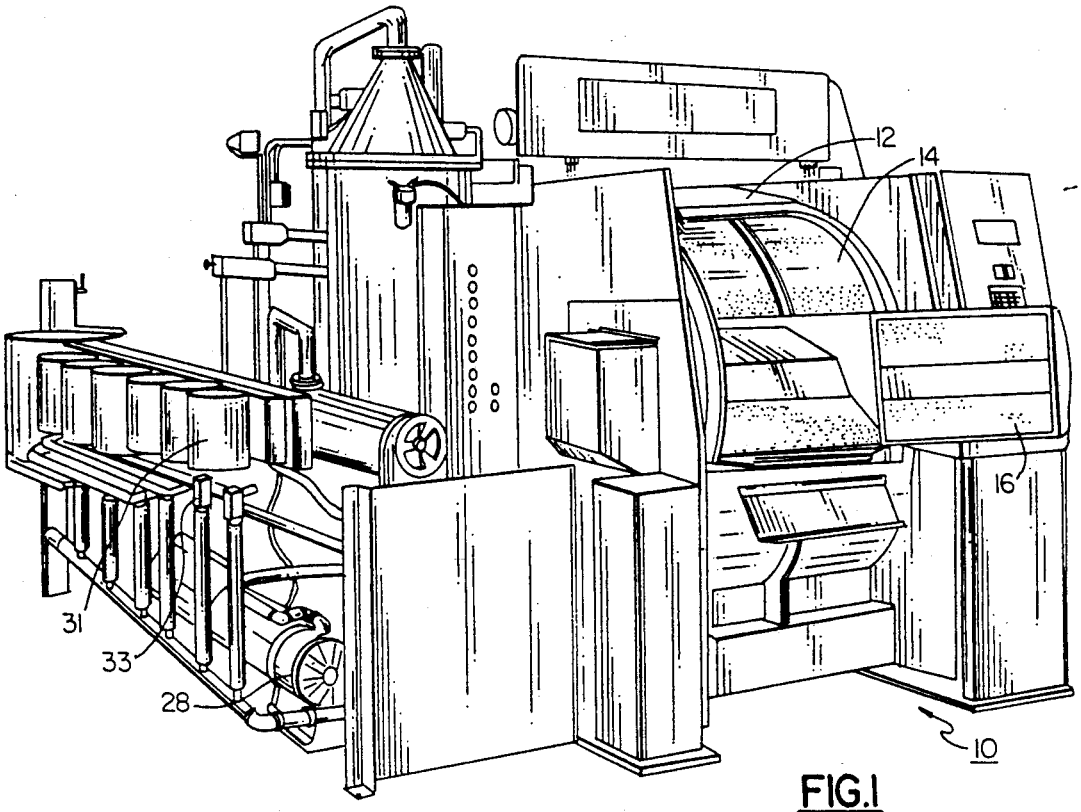
FIG. 1 is a perspective view of a machine according to the present invention.
Figure 2:
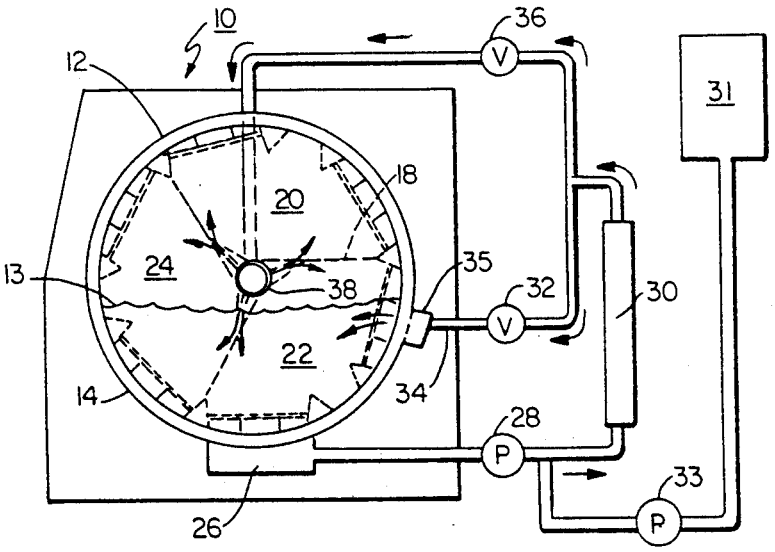
FIG. 2 is a diagrammatic end elevation partially in section of the device of the present invention.

Referring now to FIG. 1, there is shown a wet processing machine 10 generally consisting of an outer housing 12 within which is rotatably mounted a perforated basket 14 in which the goods to be dyed are placed through a door 16 which is then secured shut and the goods rotated through the liquid in the bottom portion of the chamber 12. As may be seen diagrammatically, in FIG. 2, the vessel 12 in which the liquid is placed has rotatably mounted therein the basket 14 which, as shown in FIG. 2 is divided into three compartments by the perforated partitions 18 to form three separate compartments for goods to be dyed. Each of the compartments 20, 22 and 24 are loaded through the door 16 individually and the entire basket 14 is then rotated within the vessel 12 to thoroughly process the goods in each compartment through the liquid in the vessel 12. As may be seen in FIG. 2, the vessel 12 has a sump 26 positioned at the bottom thereof. The sump 26 is connected to a pump 28 for recirculating the liquid maintained at level 13 in the vessel 12 through a heat exchanger 30 back to the vessel 12 through two different outlets, as will be described herein. One pipe from the heat exchanger 30 goes through a valve 32 into the lower back side of the vessel 12 at 34 to introduce fresh heated liquid into the vessel 12, generally below the level of the fluid in the vessel 12. Also connected to the heat exchanger 30 is another pipe that feeds fluid into the ends of a central pipe 38 positioned within the basket 14. Valve 36 controls the flow of fluid through pipe 38.

A supply of dye material is contained in tank 31 and metered by pump 33 into the liquid maintained at level 13 in vessel 12, just downstream of pump 28. In this manner suitable colors can be supplied under control of a microprocessor (not shown) as is well known in the art.

Figure 3:
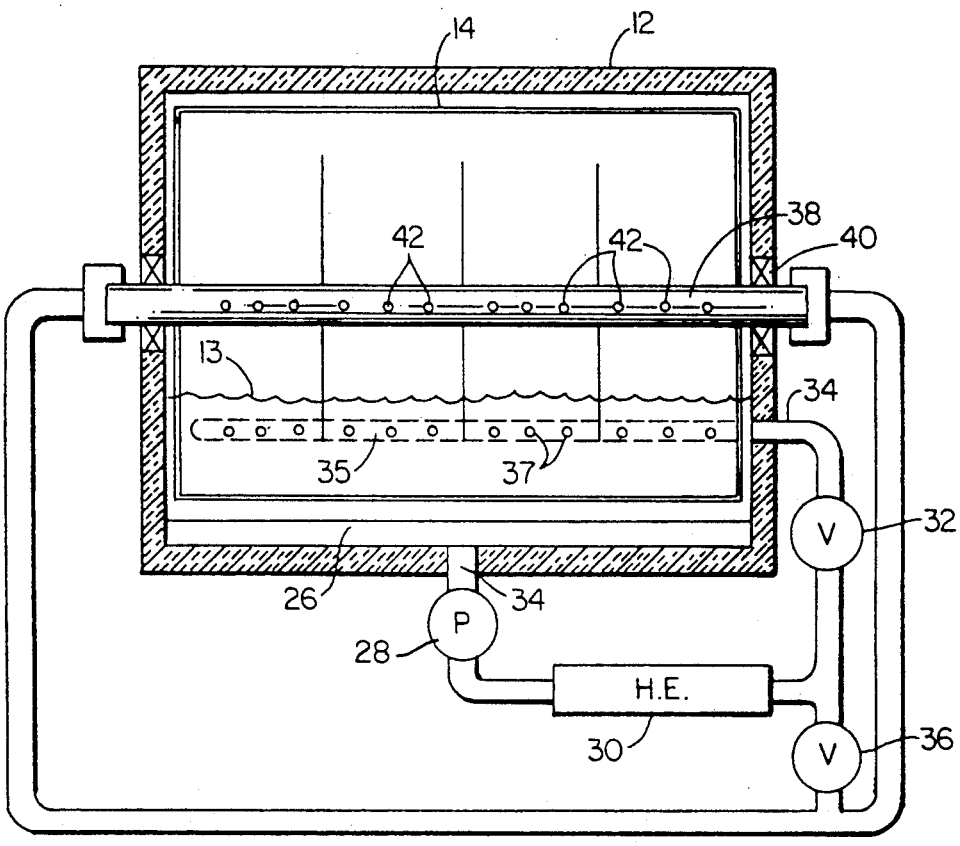
FIG. 3 is a diagrammatic longitudinal view, partially in section, of the present invention.

As may be seen more clearly in FIG. 3, the pipe 38 is journalled in bearings 40 in each end of the housing 12 for rotation within the housing 12. The basket 14 is fixed to the pipe 38 so that it rotates with the pipe within the housing 12 in the bearings 40. The fluid exiting the heat exchanger after going through valve 36 divides again at another T and is fed to both ends of the pipe 38 for distribution throughout the basket 14. The pipe 38 has a series of orifices 42 spaced therealong and spaced about the circumference of the pipe so as to provide spray orifices or nozzles in each of the three compartments of the basket 14. The holes are positioned so that they direct fluid along either side of the dividing partitions 18 so that ample liquid spray is directed into each compartment. While the specific embodiment shown has three compartments, it should be obvious to those skilled in the art that if there were lesser or greater numbers of compartments the spray orifices would be placed so as to provide spray in all of the compartments within the basket 14.

Thus, as fluid is pumped by the pump 28 through the valves 32 and 36, fluid is caused to enter the vessel 12 through valve 32 and pipe 34 and also fluid is pumped through valve 36 into both ends of the pipe 38 causing fluid to flow to the middle where the two streams meet and the pressure then builds up sufficiently to be sprayed out through the orifices 42 in the pipe 38 to provide a flow of dye liquid into the various compartments of the basket 14. Pipe 34 feeds into a distribution channel 35 which extends the length of housing 12. Channel 35 has a series of holes 37 leading into the interior of housing 12 so as to distribute the dye fluid evenly throughout the housing 12.

By providing the center shaft injection of dye material along with the channel 35 injection, a much more efficient distribution of the dye material is achieved in the goods contained within the basket which speeds up the process of dyeing the goods in the basket and improves the uniformity of color achieved throughout the goods in the basket. This is particularly true when dyeing bulky, large goods. The process shown allows dyeing from both "inside-out" and "outside-in" for maximum efficiency and uniformity. In one embodiment, experience with this system has shown that the dye is spread evenly throughout the dye bath at approximately twice the speed afforded by the use of the rear entry port or the central axial sprays only.

In addition to the faster and more effective distribution of the dye material itself, the cool down of the goods after the process of dyeing is completed is greatly facilitated. During direct cool down, cold water is blended with the bath water externally so as to prevent shocking of acrylic fiber, for instance and the water is then circulated through both the rear wall port and the central pipe distribution channels.

Indirect cool down can be similarly accomplished by reversing the heat exchanger from heating to cooling mode and gradually reducing the temperature of the circulated fluid through the vessel 12 and throughout the contents of the basket 14. As with dyeing the process and apparatus of the present invention permits cooling down from both "inside-out" and "outside-in", simultaneously thus significantly improving the efficiency of the apparatus. Another advantage of the dual feeding of the dye liquid is that uniform distribution of the dye can be obtained at lower basket rotational speeds which permits much greater flexibility in the operation of the dyeing machine and allows a gentler processing of delicate fabrics. This, in effect, controls both piling and abrasion to a much greater extent than processes and apparatus heretofore available.

While this invention has been explained with reference to the structure disclosed herein, it is not confined to the details set forth and this application is intended to cover modifications and changes as may come within the scope of the following claims:

What is claimed is:

1. An apparatus for dyeing a wide variety of goods comprising:

a liquid containing chamber, generally cylindrical in shape;

a perforated basket member rotatably mounted within said liquid containing chamber, said perforated basket member including a plurality of radially disposed perforated partitions that longitudinally divide the basket into a plurality of compartments, a spray means positioned along the center axis of said perforated basket member, the length of said spray means contained within the basket being fixed relative to said plurality of perforated partitions so that said perforated basket and said spray means rotate together in unison;

first nozzle means located at spaced intervals along said spray means contained within the basket, said first nozzle means being positioned to direct fluid into each compartment of the basket along said perforated partitions;

means for rotating said perforated basket and said spray means within said liquid containing chamber;

a fluid distribution means mounted in the lower portion of said liquid containing chamber and extending along the length of the chamber, said fluid distributing means having a plurality of spaced apart second nozzle means for directing fluid at the perforated basket; and pump means for circulating liquid containing dye material through said spray means and said fluid distribution means and for maintaining the liquid level in the chamber below said spray means and above said fluid distribution means.

2. The apparatus according to claim 1 further including first pipe means connected to both ends of said spray means;

second pipe means connected into said fluid distribution means;

valve means interconnecting said first and second pipe means; and means for introducing liquid containing dye material into said pump means for circulation through said first and second pipe means.

3. The apparatus according to claim 2 further including sump means for collecting liquid from the bottom of the chamber and directing the collected liquid to said pump means so that said pump means can recirculate the liquid containing dye material back through said first and second pipe means for reintroduction into the basket and chamber.

4. The apparatus according to claim 3 further including heat exchanger means positioned between said pump means and said first pipe means for maintaining the recirculated liquid at a predetermined temperature.

* * * * *